US005711679A

United States Patent [19]

Spickler et al.

[11] Patent Number: 5,711,679

[45] Date of Patent: Jan. 27, 1998

[54] SHIELDED MEMORY CARD CONNECTOR

[75] Inventors: John M. Spickler, Marietta, Pa.; Kazutoshi Amano, Tokyo, Japan; Chih-Hui Hsia, Taipei; Lein Wan Lu, Tao-Yuan Hsien, both of Taiwan

[73] Assignee: Berg Technology, Inc., Reno, Nev.

[21] Appl. No.: 752,756

[22] Filed: Nov. 20, 1996

Related U.S. Application Data

[63] Continuation of Ser. No. 487,922, Jul. 11, 1995, abandoned, which is a continuation-in-part of Ser. No. 369,614, Jan. 6, 1995, abandoned.

[51] Int. Cl.[6] ..... H01R 23/72

[52] U.S. Cl. ..... 439/79; 439/541.5

[58] Field of Search ..... 439/64, 59, 79, 439/80, 541.5, 108, 607

[56] References Cited

U.S. PATENT DOCUMENTS

| | | | |
|---|---|---|---|
| 3,478,251 | 11/1969 | Perotto et al. | 317/101 |
| 3,653,006 | 3/1972 | Kohler | 439/74 |
| 3,676,746 | 7/1972 | Kassabgi et al. | 439/79 |
| 3,736,471 | 5/1973 | Donze et al. | 317/101 D |
| 4,600,256 | 7/1986 | Antilla | 339/17 M |
| 4,755,911 | 7/1988 | Suzuki | 361/414 |
| 4,858,070 | 8/1989 | Buron et al. | 361/384 |
| 4,964,806 | 10/1990 | Sakamoto et al. | 439/79 |
| 5,085,590 | 2/1992 | Galloway | 439/95 |
| 5,113,317 | 5/1992 | Howe | 361/413 |
| 5,151,033 | 9/1992 | Kawai et al. | 439/95 |
| 5,161,999 | 11/1992 | Broschard, III | 439/567 |
| 5,194,010 | 3/1993 | Dambach et al. | 439/79 |
| 5,201,662 | 4/1993 | Roche | 439/377 |
| 5,224,019 | 6/1993 | Wong et al. | 361/393 |
| 5,224,865 | 7/1993 | Woith et al. | 439/67 |
| 5,225,968 | 7/1993 | Ma | 361/413 |
| 5,259,783 | 11/1993 | Hileman et al. | 439/372 |
| 5,260,854 | 11/1993 | Hileman et al. | 361/736 |
| 5,267,876 | 12/1993 | Rupert et al. | 439/540 |
| 5,268,820 | 12/1993 | Tseng et al. | 361/785 |
| 5,277,615 | 1/1994 | Hastings et al. | 439/377 |
| 5,286,207 | 2/1994 | McHugh | 439/64 |
| 5,288,247 | 2/1994 | Kaufman | 439/607 |

(List continued on next page.)

FOREIGN PATENT DOCUMENTS

| | | |
|---|---|---|
| 238008 | 1/1982 | Taiwan . |
| WO94/22182 | 9/1994 | WIPO . |

OTHER PUBLICATIONS

IBM Technical Disclosure, Planar I/O Port, vol. 33, No. 8, p. 430, Jan. 1991.

IBM Technical Disclosure Bulletin vol. 33 No. 8, p. 430 Jan. 1991.

*Primary Examiner*—Neil Abrams

*Attorney, Agent, or Firm*—Daniel J. Long; M. Richard Page

[57] ABSTRACT

A memory card connector which comprises a header (210, 210') and a carrier connected to the header, wherein the header is provided with a plurality of pins extended in both inward and outward directions. The inward pins are used for inserting a memory card to be received in the carrier. A vertical circuit board (214, 214') is electrically and securely connected to the outward pins of the header. The lower end of the vertical circuit board is detachably inserted into a connector (203, 203') securely mounted to the surface of a mainboard for electrical connection. Alternately a horizontal circuit board may be used to which the outward pins are diagonally attached and which is connected to the mainboard by a vertical connector. The height of the circuit board can be set according to the requirement of a specific application of the memory card connector so that the space between the memory card connector and the mainboard can be properly utilized. The outward pins are shielded by means of a conductive shield (322, 322' or 522, 522') and that conductive shield is grounded to the mainboard through a ground plane in the vertical or horizontal circuit board. The ground plane is interposed between signal planes in parallel, spaced and equal distance relation between two signal planes. One group of outward extending pins is connected to each of the signal planes to control impedance.

21 Claims, 7 Drawing Sheets

U.S. PATENT DOCUMENTS

| | | | |
|---|---|---|---|
| 5,290,174 | 3/1994 | Woratyla et al. | 439/59 |
| 5,297,966 | 3/1994 | Brennian et al. | 439/64 |
| 5,299,089 | 3/1994 | Lwee | 361/684 |
| 5,305,182 | 4/1994 | Chen | 361/684 |
| 5,308,251 | 5/1994 | Kaufman et al. | 439/64 |
| 5,316,488 | 5/1994 | Gardner et al. | 439/79 |
| 5,318,452 | 6/1994 | Brennian et al. | 439/79 |
| 5,324,204 | 6/1994 | Lwee | 439/64 |
| 5,334,046 | 8/1994 | Brouillette et al. | 439/540 |
| 5,399,105 | 3/1995 | Kaufman et al. | 439/609 |
| 5,401,176 | 3/1995 | Lwee | 439/64 |
| 5,408,386 | 4/1995 | Ringer et al. | 361/785 |
| 5,415,569 | 5/1995 | Colleran | 439/620 |
| 5,478,260 | 12/1995 | Kaufman | 439/609 |
| 5,490,791 | 2/1996 | Yamada et al. | 439/159 |

SHIELDED MEMORY CARD CONNECTOR

CROSS REFERENCED TO RELATED APPLICATION

This application is a file wrapper continuation of application Ser. No. 08/487,922 filed Jul. 11, 1995 and now abandoned which is a continuation-in-part of application Ser. No. 08/369,614 filed Jan. 6, 1995, entitled "Memory Card Connector" and now abandoned.

BACKGROUND OF INVENTION

1. Field of the Invention

This invention relates to electrical connectors, and more particularly, to memory card connectors for use in notebook computers, PC printers and palmtop computers which can expand the space under the connector for installing electronic components and can be maintained easily.

2. Brief Description of the Prior Developments

Rapid progress in various personal computer technologies and improvements in shrinking-size components may make notebook computers the most popular computers in the computer market in the future. For note book computers (or PC printers, palmtop computers) equipped with PCMCIA (Personal Computer Memory Card International Association) slots, memory card connectors are used for connecting PCMCIA cards loaded in the slots to the mainboard of the notebook. A conventional memory card connector is usually installed on a mainboard by using SMT (Surface Mounting Technology) which solders the pins of the connector directly to the surface of the mainboard. Such rigid connection usually causes serious maintenance problems if the connector is to be replaced later on. Besides, the bottom of the conventional memory card connector is directly placed on the surface of the mainboard. The occupied area under the connector can not be used for other purposes such as installing electronic components. Such waste in mainboard space is usually not tolerable in notebook computers which have very restrictive mainboard space.

SUMMARY OF THE INVENTION

The memory card connector of the present invention may be detachably mounted on a mainboard. The memory card connector comprises a header and a carrier connected to the header, wherein the header is provided with a plurality of pins extended in both inward and outward directions, and a vertical circuit board is electrically and securely connected to the outward pins of the header. The lower end of the circuit board is detachably inserted into a connector of the mainboard.

In the memory card connector of the present invention the height of the circuit board of the connector can also be set according to the requirement of a specific application of the connector so that the space (stand-off) between the connector and the mainboard can be properly utilized.

Additionally two memory card connectors which may be stacked together, such that the outward pins of the upper connector are longer than the outward pins of the lower connector and the two vertical circuit boards respectively connected to the upper and lower connectors are detachably and vertically connected to two corresponding connectors of the mainboard separately.

Additionally, means may also be provided for shielding the outward pins. The shielding means will be grounded to the mainboard by means of a grounding plane which is interposed between two signal planes at equal distances in spaced, parallel relation. A portion of the pins are connected to one signal plane while the rest of the pins are connected to the other signal plane to achieve effective impedance control.

BRIEF DESCRIPTION OF THE DRAWINGS

The memory card connector of the present invention will be more fully understood and appreciated by reference to the written specification in conjunction with the accompanying drawings in which.

DETAILED DESCRIPTION OF THE PREFERRED EMBODIMENTS

Figure 1:
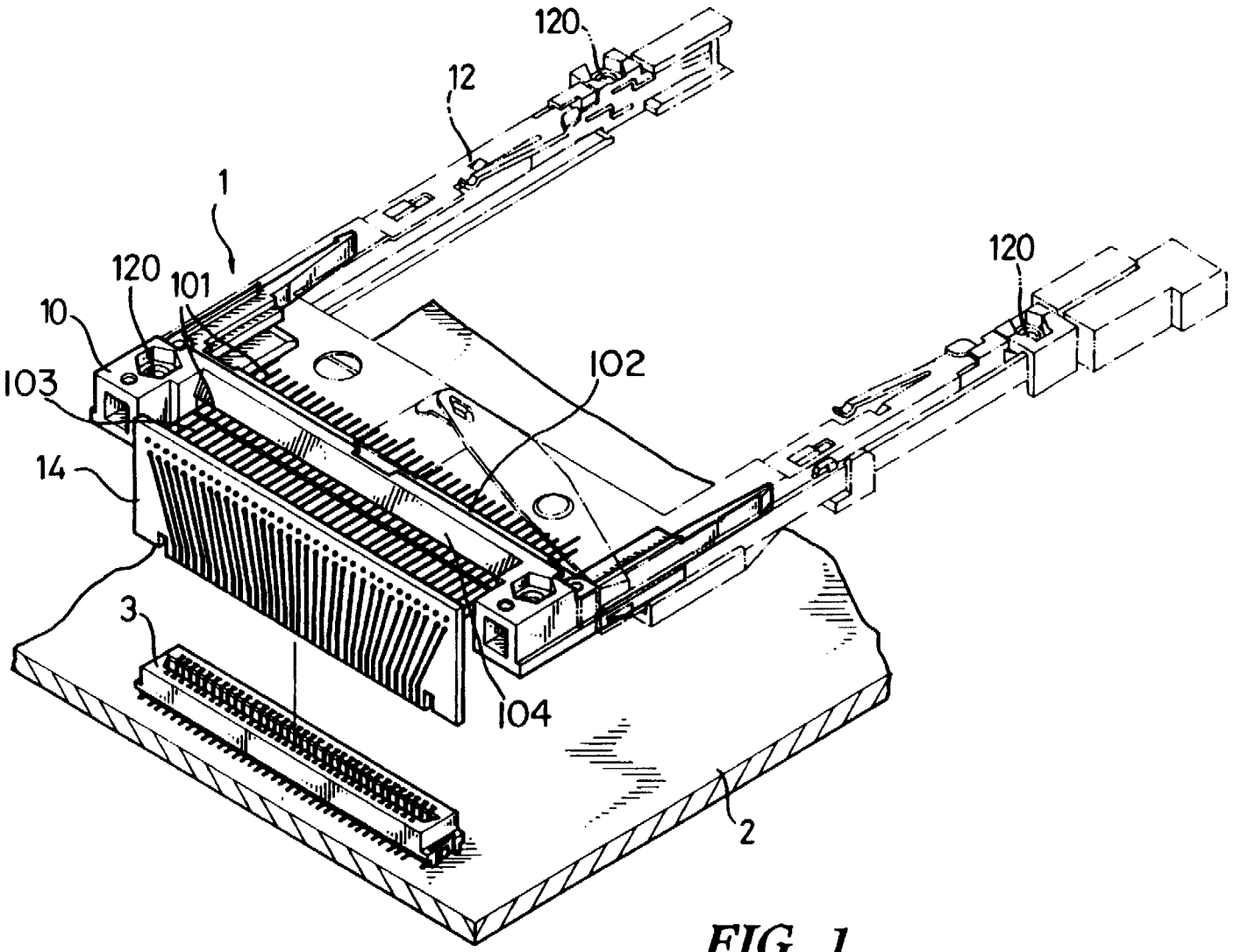
FIG. 1 is an exploded view of a memory card connector and its associated mainboard according to the present invention.

Referring now to FIG. 1, a memory card connector 1 according to the present invention comprises a header 10 and a carrier 12 connected to the header 10. The connection between the header 10 and the carrier 12 can be fixed or separated in the known manner, which is not the characteristic feature of the invention and is omitted in the description hereinafter. The header 10 is provided with a plurality of pins 101 extended in both inward and outward directions. The inward pins 101 extending from the inward edge 102 of the header are used for inserting a memory card (not shown) to be received in the carrier 12. A vertical circuit board 14 is electrically and securely connected to the outward pins 103 extending from the outward edge 104 of the header 10. A connector 3 is securely mounted to the surface of a mainboard 2 for mounting the memory card connector 1. The lower end of the vertical circuit board 14 is detachably inserted into the connector 3 to effect electrical connection.

Figure 2:
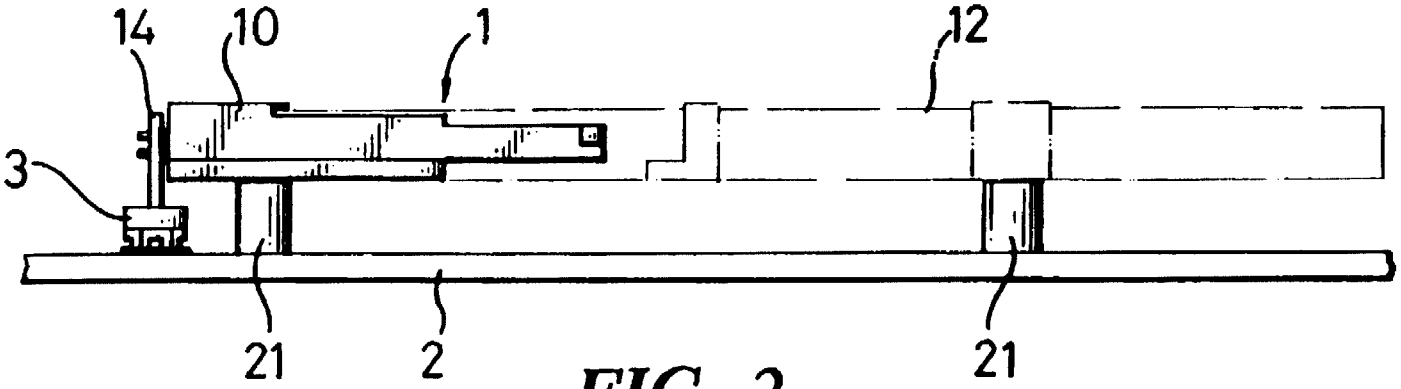
FIG. 2 is a side elevational view of a second embodiment of the invention illustrating a memory card connector installed on a mainboard according to the present invention.

With reference to FIG. 2, in installing the connector 1 to the mainboard 2, the lower end of the circuit board 14 is directly plugged to the connector 3 and the bottom of connector 1 is horizontally supported by four studs 21 provided on the mainboard 2. The connector 1 can be fastened to the studs 21 by using screws (not shown) respectively received in the four studs 21 passing through four screw mounting holes 120 of connector 1. The height of the circuit board 14 is set according to the requirement of a specific application of the memory card connector so that the space between the memory card connector 1 and the mainboard 2 can be properly utilized.

Figure 3:
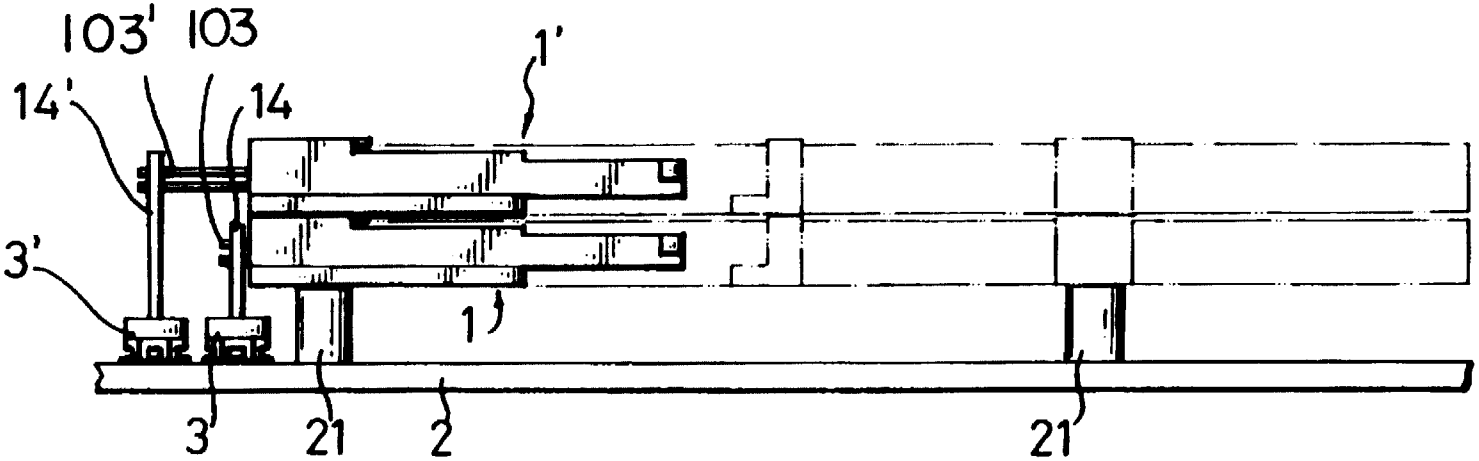
FIG. 3 is a side elevational view illustrating two memory card connectors stacked together and installed on a mainboard according to the present invention.

In FIG. 3, two memory card connectors 1 and 1' are stacked together and installed on the mainboard 2. The outward pins 103' of the upper connector 1' are longer than the outward pins 103 of the lower connector 1. Circuit board 14' in the upper connector 1' is larger to fit the real height as required. Two vertical circuit boards 14' and 14 respectively connected to the upper and lower connectors 1' and 1 are detachably and vertically connected to two corresponding connectors 3' and 3 of the mainboard 2 separately.

Figure 4:
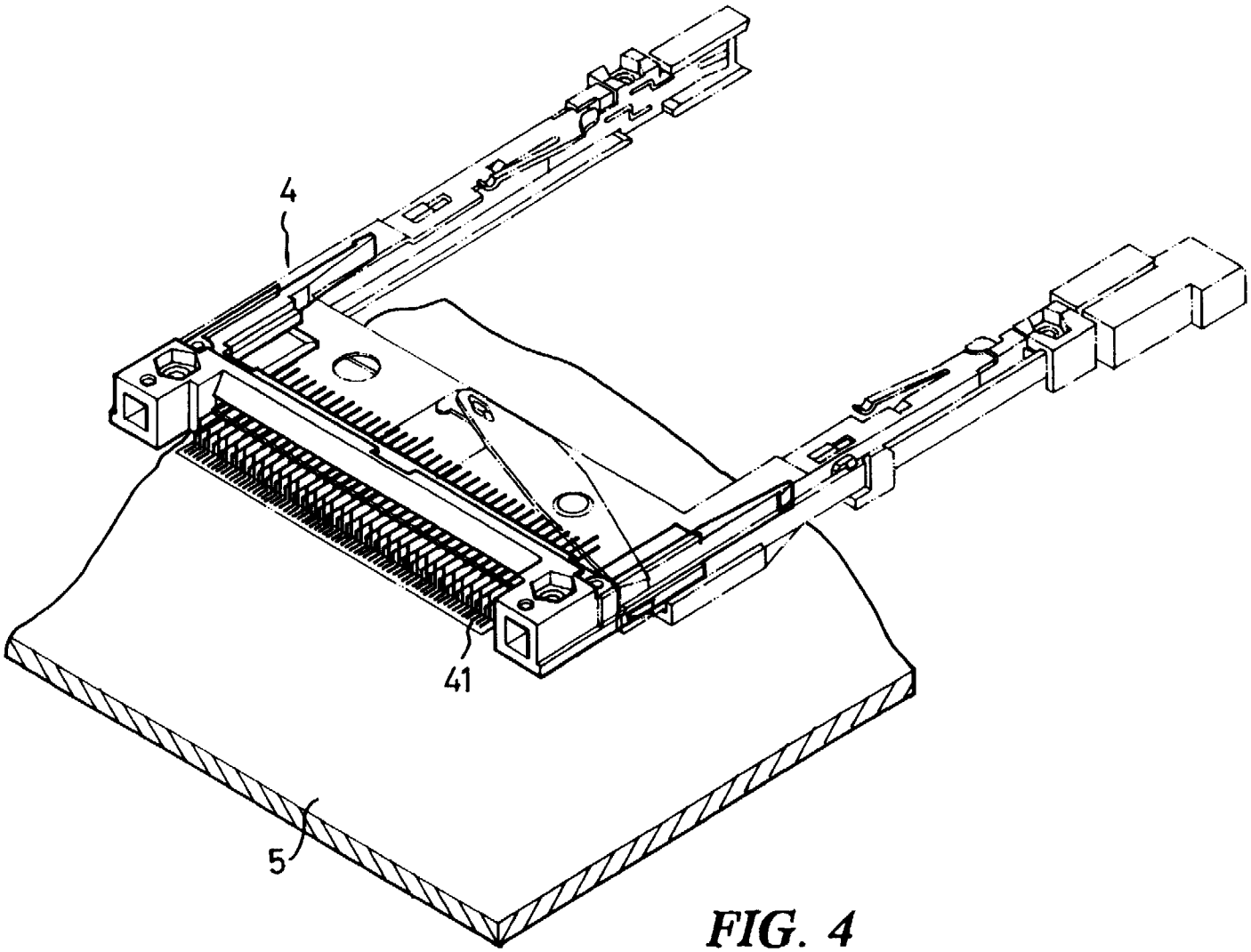
FIG. 4 (PRIOR ART)
FIG. 4 is a perspective view illustrating a conventional memory connector installed on a mainboard.
Figure 5:
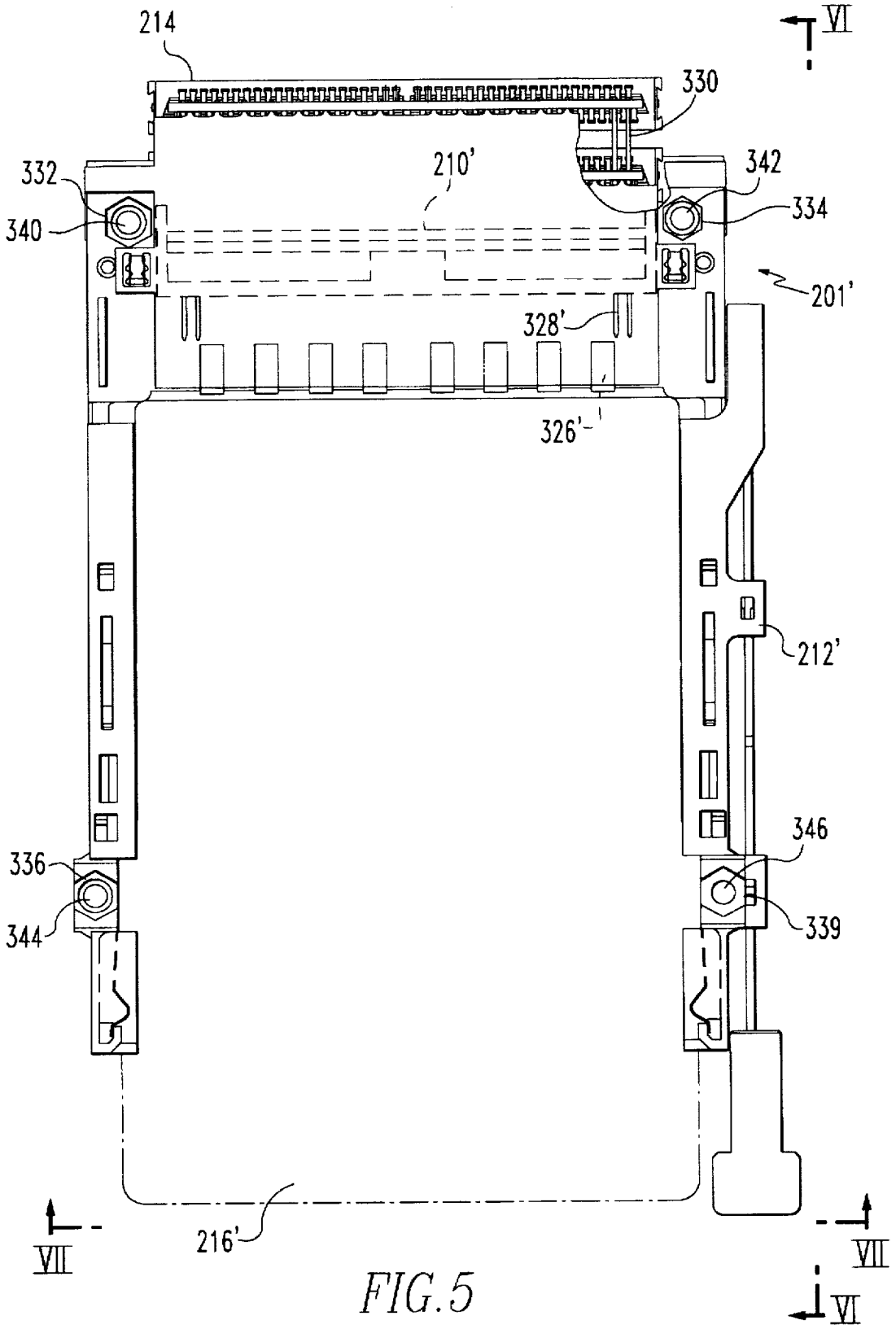
FIG. 5 is a top plan view of a memory card connector representing a third preferred embodiment of the present invention.

In FIG. 4, a conventional memory connector 4 installed on a mainboard 5 is illustrated. The connector 4 comprises a plurality of bending pins 41 which are directly soldered to the mainboard 5 by using SMT. As compared with the connector 1 in accordance with the present invention, it is difficult to replace the known installed connector 4 because it is securely fixed on the mainboard 5 which will cause a serious problem in maintenance. Furthermore, there is no space available under connector 4 for use such as installing electronic components.

Figure 8:
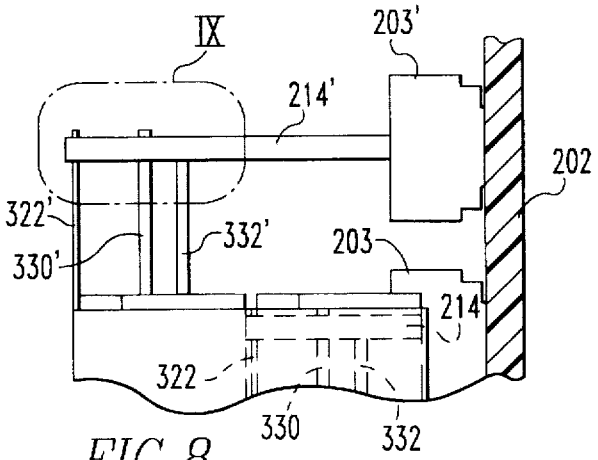
FIG. 8 is a detailed enlarged view of area VIII in FIG. 6.
Figure 9:
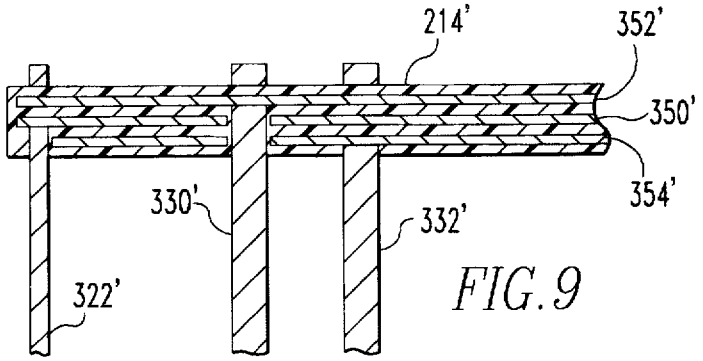
FIG. 9 is a detailed cross sectional view of area IX in FIG. 8.
Figure 6:
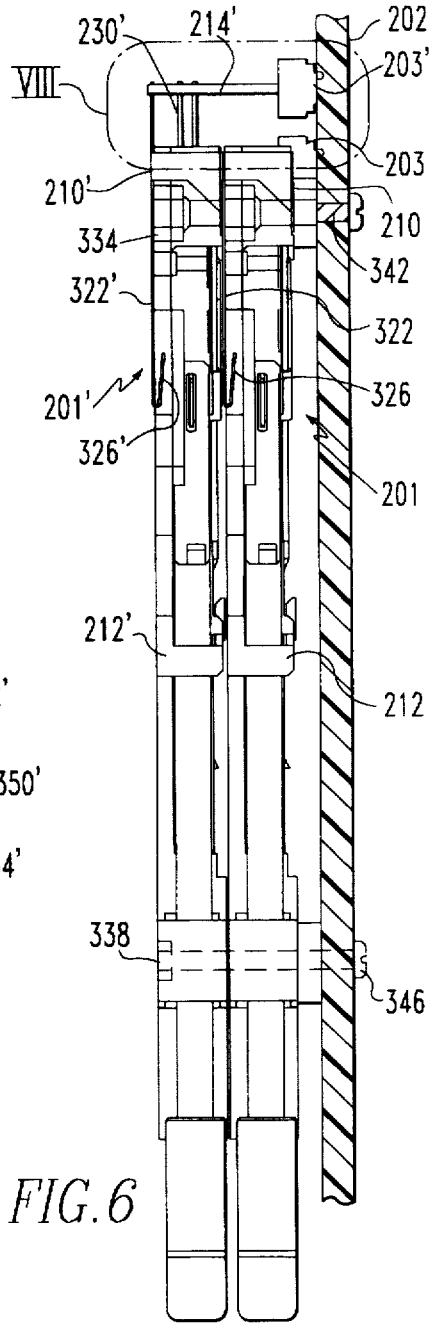
FIG. 6 is a side elevational view from line VI—VI of the memory card connector shown in FIG. 5.
Figure 7:
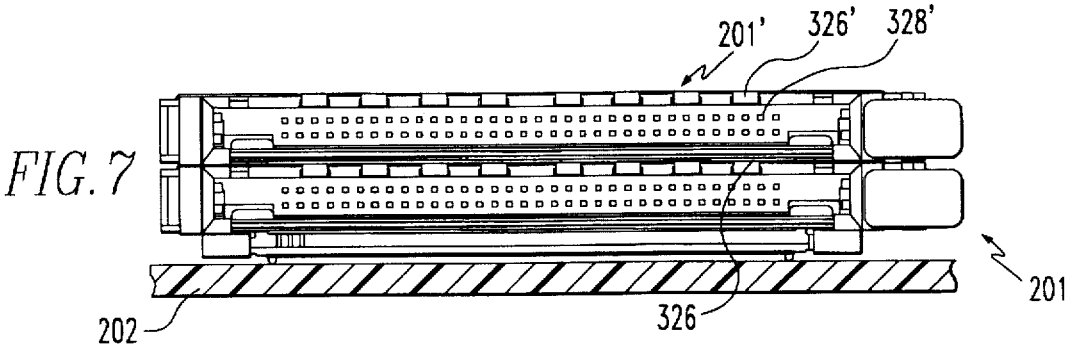
FIG. 7 is a front end view from line VII—VII of the memory card connector shown in FIG. 6.

Referring to FIGS. 5–8, there is shown a composite of stacked memory card connectors 201 and 201' according to another embodiment of the present invention comprises headers 210' and 210 and carriers 212' and 212 connected respectively to the headers 210' and 210. Similar to the embodiment shown in FIG. 3, two memory card connectors 201 and 201' are stacked together and installed on a mainboard 202. As with the first two embodiments, the connection between the header and the carrier can be fixed or separated in the known manner, which is not the characteristic feature of the invention and is omitted in the description hereinafter. As was also described above, the header is provided with a plurality of pins extending in both directions as in an inward direction 328' and in an outward direction as at 330' and 332' and 330 and 332. The inward pins extending from the inward edge of the header are used for inserting memory cards shown as at 216' in phantom lines in FIG. 5 to be received in the carrier. Vertical circuit boards 214' and 214 are electrically and securely connected to the outward pins extending from the outward edge of the header. connectors 203' and 203 are securely mounted to the surface of a mainboard for mounting the memory card connector. A suitable connector would be one of the CONAN series receptacles available from Berg Electronics, Inc. of St. Louis, Mo. With such a connector, ground plane connection between the vertical circuit board and the connector will preferably be generally equally distributed over the connector length. The lower end of the vertical circuit board is detachably inserted into the connector to effect electrical connection. As was described in connection with the first two embodiments, in installing the connector to the mainboard the lower end of the circuit board 214' is directly plugged to the connector 203' and the lower end of circuit board 214 is directly plugged into the connector 203. The bottom of connector 201 and 201' are horizontally supported by four studs 333, 334, 336 and 338 provided on the mainboard. The connector can be fastened to the studs by using screws 340, 342, 344 and 346 respectively received in the four studs passing through four screw mounting holes as at 320 of the connector. The height of the circuit board 214' is set according to the requirement of a specific application of the memory card connector so that the space between the memory card connector and the mainboard can be properly utilized. It will also be seen that lower and upper memory card connectors 201 and 201' are stacked together to be installed over the mainboard. The outward upper pins as at 203' of the upper connector 201' are connected to the vertical board 214'. A conductive ground shield 322' overlaps the pins as at 330' and 332' extending from connector 201'. Another conductive ground shield 322 overlaps the pins as at 330 and 332 and separates those lower pins from the upper pins as at 330' and 332'. As is shown in FIG. 9, the vertical circuit board 214' has a central metallic ground plane 350' and opposed lateral metallic signal planes 352' and 354' which are parallel to and spaced from ground plane 350' at equal distances. These ground and signal planes extend downwardly to connector 203' to effect grounding and connection respectively to the mainboard. It will also be observed that the conductive shield 322' is isolated from signal planes 352' and 354' and contacts ground plane 350' to be grounded through that ground plane and connector 203' to the mainboard. Similarly, pin 330' is isolated from ground plane 350' and signal plane 354' to contact signal plane 352' and to be connected through that signal plane 352' and connector 203' to the mainboard. Pin 332' is also isolated from ground plane 350' and signal plane 352' to contact signal plane 354' to be connected through that signal plane 354' and connector 203' to the mainboard. It will also be understood that the other outwardly extending pins which are horizontally aligned with pin 330' will contact and be connected to the mainboard through signal plane 352' and the other outwardly extending pins which are horizontally aligned with pin 332' will contact and be connected to the mainboard through signal plane 354'. Because the signal planes 352' and 354' are spaced in parallel, equal distance relation to ground plane 350', it will be appreciated that impedance will be effectively controlled. Referring particularly to FIG. 8, it will be seen that there is also a vertical board 214 which is connected to connector 203. This vertical board has an internal medial ground plane (not shown) and opposed signal planes (not shown) which are parallel to and equal distanced from the ground plane and which are essentially similar to the ones described above in connection with board 214'. In a manner similar to that described above in connection with shield 322' is connected to the ground plane and pins 330' and 332', shield 322 and pins 330 and 322 are each connected to one of said separate parallel signal planes for impedance controlled grounding and signal transmission to the mainboard. The use of a medial ground plane with such equally spaced parallel lateral signal planes generally allows sufficient impedance control so that various heights of the vertical boards can be used without adversely affecting performance. Both shields 322 and 322' shields are connected to an adjacent memory card by means of fingers as at 326 and 326'. This connection is preferably in accordance with the PCMCIA/JEIDA PC standard released February, 1995 (Document No. 0295-03-1500).

Figure 10:
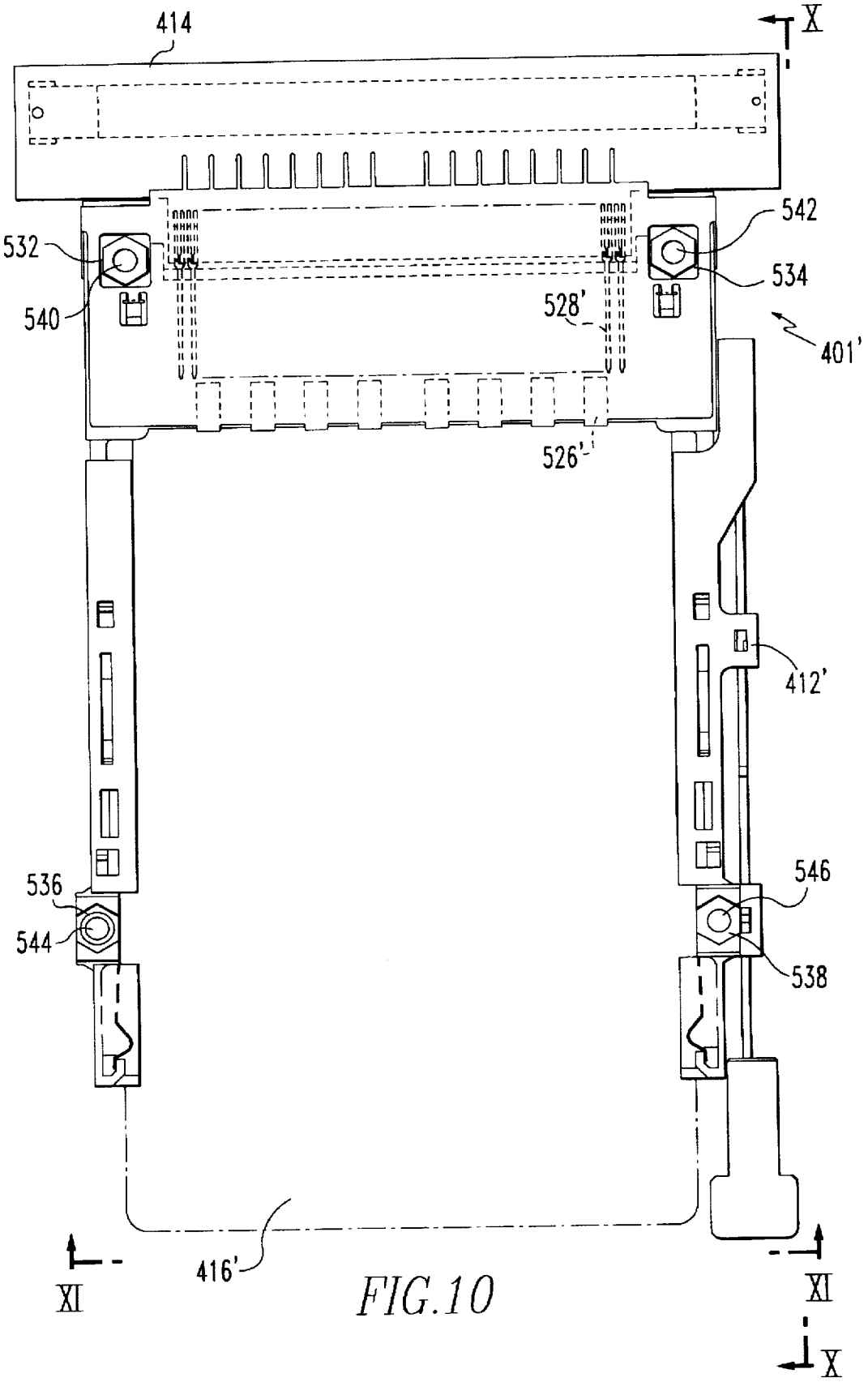
FIG. 10 is a top plan view of a memory card connector representing a preferred embodiment of the present invention.
Figure 11:
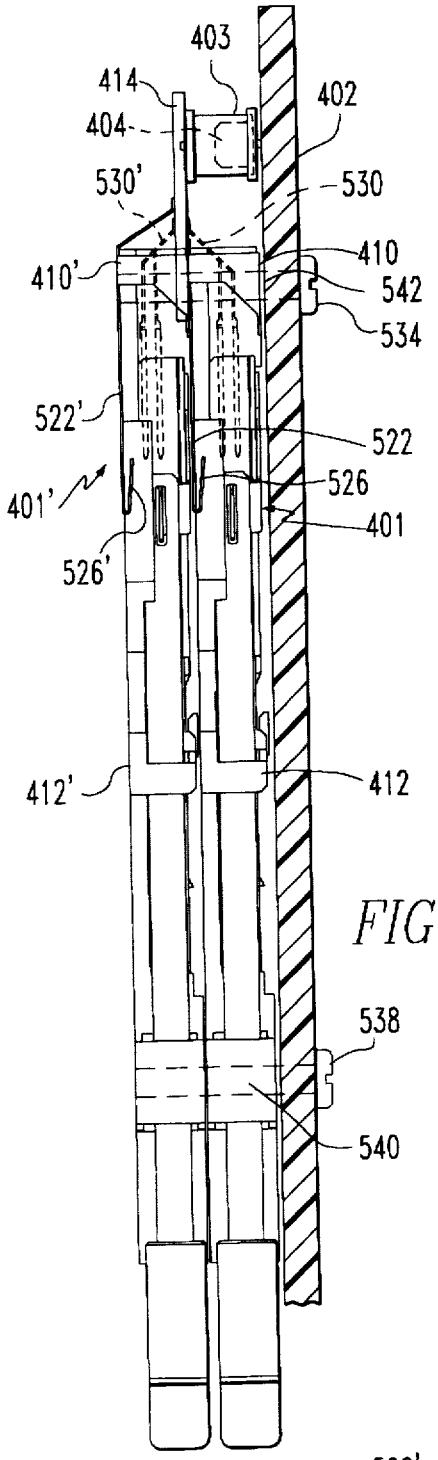
FIG. 11 is a side elevational view from line XI—XI of the memory card connector shown in FIG. 10.
Figure 12:
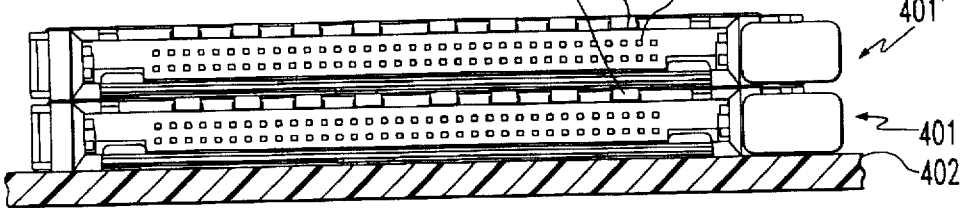
FIG. 12 is an end view from line XII—XII of the memory card connector shown in FIG. 10.

Referring to FIGS. 10–12, another composite of stacked memory card connectors 401 and 401' is shown. In this alternate preferred embodiment carriers 412 and 412' are connected respectively to headers 410 and 410'. Memory card connectors 401 and 401' are stacked together and installed on a mainboard 402. As with the other embodiments described above, the connection between the header and the carrier can be fixed or separated in the known manner. As was also described above, the header is provided with a plurality of pins extending in both inward and outward directions. The inward pins extending from the inward edge of the header are used for inserting memory cards as at shown in FIG. 10 in phantom lines at 416' to be received in the carrier. A horizontal circuit board 414 is electrically and securely connected to outward pins as at 530' and 530 extending respectively from the outward edges of both headers 410' and 410. A plug 404 is securely mounted to the surface of a mainboard 402 for mounting the memory card connector. The bottom side of the horizontal circuit board is soldered to a receptacle 403 which is engaged with plug 404 to effect electrical connection between board 414 and the mainboard. The bottom of connectors 401 and 401' are horizontally supported by four studs 533, 534, 536 and 538 provided on the mainboard. The connectors can be fastened to the studs by using screws 540, 542, 544 and 536 respectively received in the four studs passing through four screw mounting holes as at 520 of the connector. Although not shown, the horizontal circuit board 414 may be constructed similar to the vertical circuit board 214' described above with a medial ground plane interposed between parallel, equally spaced signal planes. It will also be seen that lower and upper memory card connectors 401 and 401' are stacked together to be installed over the mainboard. The outward upper pins as at 530' of the upper connector 401' extends diagonally downwardly to engage the horizontal board 414. Lower pins as at 530 from the lower board 401 extend diagonally upwardly to engage the horizontal circuit board. A conductive ground shield 522' overlaps the pins as at 530' extending from connector 401'. Another conductive ground shield 522 overlaps the pins as at 530 and separates those lower pins from the upper pins as at 530'. The upper and lower pins contact conductive pads respectively on the top and bottom surfaces of the horizontal circuit board and then to the signal planes. The shields contact conductive pads on the top and bottom surfaces of the horizontal circuit board and are then connected to the medial ground plane in the horizontal circuit board. Both shields 530' and 530 are connected to an adjacent memory card by means of fingers as at 526 and 526'. This connection is preferably in accordance with the PCMCIA/JEIDA PC standard released February, 1995 (Document No. 0295-03-1500).

It will be appreciated that a memory card connector has been described which provides an efficient and economical means for providing space for electronic components.

It will also be appreciated that a method for advantageously connecting a memory card connector to a main circuit board has been provided in which the outwardly extending pins are connected to a vertical circuit board and that vertical circuit board is connected to the main circuit board.

It will also be appreciated that a means for efficiently, effectively and economically shielding such memory card connectors and also controlling impedance has also been described.

While the structure and features of the present invention have become more apparent from the above detailed description and illustration, it is to be understood that the embodiment has been described only by way of illustrating the preferred operation of the present invention without limiting the scope of the present invention. Therefore, it is intended that any modifications and changes that can be made to the embodiment without departing from the spirit of the present invention are within the scope as set forth in the appended claims.

What is claimed is:

1. A memory card connector for connecting a memory card to a main circuit board comprising:

(a) a header having a plurality of inwardly extending pins and a plurality of outwardly extending pins;

(b) electrical conductive means connected to the outwardly extending pins so that said electrical conductive means and said outwardly extending pins are electrically connected to the main circuit board; and (c) conductive shielding means at least partially enclosing the outwardly extending pins and electrically connected to the conductive means to be grounded to the main circuit board through the electrical conductive means wherein the conductive means comprises a conductive ground plane connected to the shielding means and at least one separate conductive signal plane connected to at least some of the outwardly extending pins.

2. The memory card connector of claim 1 wherein the header has an inward edge and the inwardly extending pins extend from the inward edge of the header.

3. The memory card connector of claim 2 wherein the header has an outward side and the outwardly extending pins extend from the outward edge of the header.

4. The memory card connector of claim 1 wherein the conductive means comprises two separate conductive signal planes positioned at equal distances from the ground plane.

5. The memory card connector of claim 4 wherein a first group of the outwardly extending pins is connected to one signal plane and a second group of the outwardly extending pins is connected to the other signal plane.

6. The memory card connector of claim 5 wherein the ground plane is interposed in parallel spaced relation between the signal planes.

7. The memory card connector of claim 1 wherein the electrical conductive means is a second circuit board.

8. The memory card connector of claim 7 wherein the second circuit board is positioned in generally perpendicular relation to said outwardly extending pins.

9. The memory card connector of claim 8 wherein the second circuit board is positioned in generally perpendicular relation to said main circuit board.

10. The memory card connector of claim 9 wherein there is a connector on the main circuit board and a lower end on the second circuit board and said lower end is detachably inserted into the connector.

11. The memory card connector of claim 10 wherein a second memory card connector is positioned in spaced parallel relation to said first memory card connector.

12. The memory card connector of claim 11 wherein the second memory card connector comprises (a) a header having a plurality of inwardly extending pins and a plurality of outwardly extending pins; and (b) electrical conductive means connected to the outwardly extending pins.

13. The memory card connector of claim 12 wherein at least part of the shielding means is interposed in parallel relation between the first and second memory card connectors.

14. The memory card connector of claim 11 wherein at least part of the shielding means is superimposed over the first and second memory card connectors.

15. The memory card connector of claim 7 wherein the second circuit board is positioned in generally parallel relation to said main circuit board.

16. The memory card connector of claim 15 wherein the outwardly extending pins are oriented diagonally with respect to the second circuit board.

17. The memory card connector of claim 16 wherein the second circuit board is connected to the main circuit board by an electrical connector extending perpendicularly between said second circuit board and main circuit board.

18. The memory card connector of claim 15 wherein a second memory card connector is positioned in spaced parallel relation to said first memory card connector.

19. The memory card connector of claim 18 wherein the second memory card connector comprises (a) a header having a plurality of inwardly extending pins and a plurality of outwardly extending pins; and (b) electrical conductive means connected to the outwardly extending pins.

20. The memory card connector of claim 19 wherein at least part of the shielding means is interposed in parallel relation between the first and second memory card connectors.

21. The memory card connector of claim 20 wherein at least part of the shielding means is superimposed over the first and second memory card connectors.

* * * * *